United States Patent [19]

Payen

[11] 4,299,884

[45] Nov. 10, 1981

[54] TYPE OF WRAPPED TEXTILE THREAD AND PROCESS FOR ITS PRODUCTION WHICH INVOLVES THERMOFUSION TO SECURE WRAPPING TO CORE

[75] Inventor: Pierre Payen, Lyons, France

[73] Assignee: L. Payen & Cie, Lyons, France

[21] Appl. No.: 108,175

[22] Filed: Dec. 28, 1979

[30] Foreign Application Priority Data

Oct. 1, 1979 [FR] France ..... 79 01172

[51] Int. Cl.[3] ..... D02G 3/28; D02G 3/36; D02G 3/38; D02G 3/40

[52] U.S. Cl. ..... 428/377; 57/3; 57/224; 57/229; 57/230; 57/234; 57/293; 57/298

[58] Field of Search ..... 428/377; 57/3, 224, 57/229, 234, 293, 297, 230

[56] References Cited

U.S. PATENT DOCUMENTS

| | | | |
|---|---|---|---|
| 2,112,294 | 3/1938 | Lilley | 57/234 |
| 2,146,966 | 2/1939 | Lilley | 57/234 |
| 2,313,058 | 3/1943 | Francis . | |
| 2,424,743 | 7/1947 | Davis . | |
| 3,002,334 | 10/1961 | Yasuno | 57/234 |
| 3,089,379 | 5/1963 | Finor et al. | 57/234 |
| 3,446,002 | 5/1969 | Kippon | 57/234 |
| 3,446,004 | 5/1969 | Wilterink | 57/234 |
| 3,458,987 | 8/1969 | Ozawa et al. | 57/224 |
| 3,644,866 | 2/1972 | Deardurff . | |
| 3,745,746 | 7/1973 | Crandall | 57/234 |
| 4,016,714 | 4/1977 | Crandall et al. | 428/377 |

FOREIGN PATENT DOCUMENTS

| | | |
|---|---|---|
| 2704836 | 5/1977 | Fed. Rep. of Germany . |
| 2314958 | 1/1977 | France . |
| 63345 | 1/1973 | Luxembourg . |
| 1322336 | 7/1973 | United Kingdom . |

*Primary Examiner*—James C. Cannon

*Attorney, Agent, or Firm*—Arnold, White & Durkee

[57] ABSTRACT

There is provided a new wrapped textile thread which includes a core made of threads arranged considerably parallel to each other. The core is covered by a wrapping thread which winds in a single turn, forming a regular and joined spiral around the core. This textile thread is characterized by the fact that at least one part of the peripheral surface of the core is joined together by heat sealing with the wrapping of winding thread. The textile thread is useful in textile materials which require a very good resistance against abrasion.

6 Claims, 4 Drawing Figures

Fig. 1
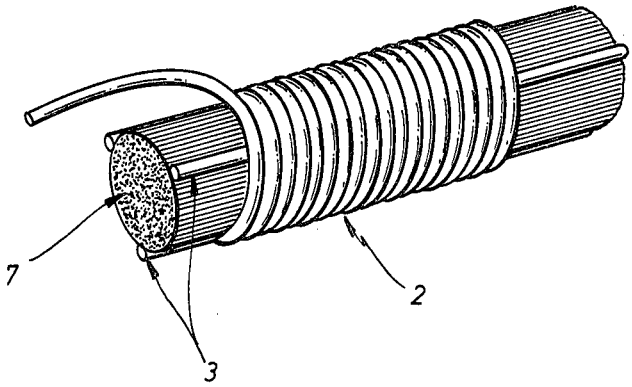
Fig. 2
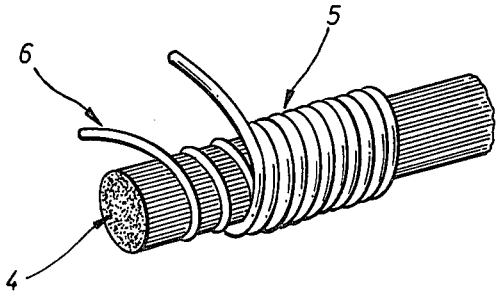
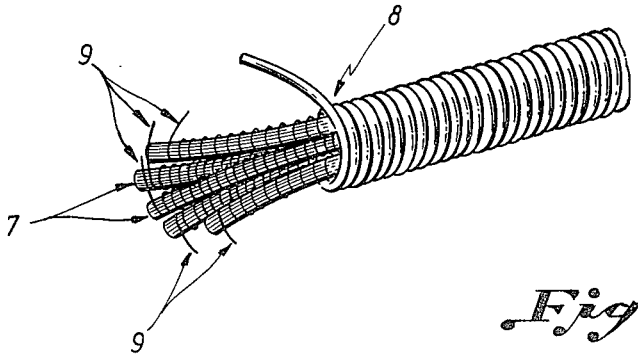
Fig. 3

TYPE OF WRAPPED TEXTILE THREAD AND PROCESS FOR ITS PRODUCTION WHICH INVOLVES THERMOFUSION TO SECURE WRAPPING TO CORE

BACKGROUND OF THE INVENTION

1. Field of the Invention

The present invention deals with a new type of wrapped thread and a process for its manufacture.

2. Description of the Prior Art

It is well known how to wrap threads. Schematically, this process consists of spirally winding a thread, called "covering" or "wrapping thread," around a second thread called "core thread." Depending on whether or not only one or several wrapping threads are used, it is described as a simple or a crossed wrapping. This technique of wrapping is very widely used in the fabrication of fancy threads and of elastic threads with an elastomeric core.

It is also known to use fragile threads, such as glass thread, threads of thermostable synthetic materials such as those made of aromatic polyamide, or threads of a refractory substance, with a cross directional sense of wrapping. In this case, the fragile thread forms the core, and the wrapping thread, advantageously made of synthetic thermoplastic material, is wound in a simple spiral (simple wrapping) in regular single and joined turns around the thread of the core which is kept in the shape of a straight line, whereby the wrapping thread protects the said core thread. Such a wrapped thread is described in the commonly assigned French Pat. No. 2,314,958, and it is used in the production of materials destined to reinforce plastic substances.

This latter technique, notably commercialized by L. Payen & Cie, still shows a certain number of inconveniences. Indeed, if, as is often the case, the core thread has a diameter which is greater than the diameter of the wrapping thread, the latter has the troublesome tendency to slip over the mentioned core. Therefore, the core thread is at once badly protected against abrasion from the outside, which means the abrasion suffered by the core thread with respect to another element, and equally badly against inside abrasion, which means the abrasion which is derived fromm the rubbings among the elemental fibers which form the core thread.

The present invention reduces these inconveniences. It deals with a new type of wrapped thread which has a very good resistance against abrasion from the outside as well as inside, and wherein the distinctive features of the core are practically unchanged by the presence of the thread of the outside wrapping.

Certainly, it is already known to make use of the phenomenon of gluing to modify the properties of thread-like textile elements. Thus, German Pat. No. DE-A 2,704,836 describes stringings, especially for supporting goods (tennis rackets) or musical instruments, where a core is covered by a binding liquid substance which dries immediately. Eventually, the core is covered by winding loose threads around it.

Moreover, it has been disclosed in the U.S. Pat. No. 3,644,866 to keep the parallel thread in position by means of a double-wrapped thread made in a loose manner. Before the wrapping, the core threads are bathed in a binding substance which ties them together.

The U.S. Pat. Nos. 2,313,058 and 2,424,743 both describe threads formed by the combination, via twisting, of two threads where one of them can be made adhesive by heat treatment. The heat treatment joins the fibers of the non-thermofusible thread together and improves the properties of the produced articles.

Likewise, the British Pat. No. 1,322,336 and the Luxemburg Pat. No. 66,345 describe the use of binding substances in order to modify the properties of textile materials.

Nevertheless, none of these disclosures provide wrapped threads having a very good resistance against abrasion from the outside as well as inside, and where the distinctive features of the core are practically unchanged by the presence of the outside wrapping thread, the latter being tied to the core by means of a very small quantity of heat sealing substance, where this substance does not modify the general distinctive features of the obtained thread.

SUMMARY OF THE INVENTION

In a general way, the invention deals with a new wrapped textile thread of the type which comprises a core consisting of threads which are appreciably parallel to one another, the mentioned core being covered by a wrapping thread which winds in a single turn forming a regular and joined spiral with at least one part of the peripheral surface of the core joined together by heat sealing with the wrapping thread. The textile thread is characterized by the fact that the binding of the core with the wrapping thread is obtained by fusion of a thread-like thermofusible element with a fusion temperature which is lower than the fusion temperature of the core and the wrapping.

In practice, in accordance with the invention, the weight of the thread thus obtained will comprise, with respect to the whole produced unit, at the most, ten percent (10%) heat sealing substance permitting the binding of the core with the wrapping thread, the latter representing, at the most, twenty-five percent (25%) of the produced unit.

Advantageously, in accordance with the invention, the multithreaded core composed of a plurality of individual threads, parallel or very slightly twisted, is made of fragile textile material, and is composed of, for example, glass threads, threads of a refractory material, such as carbon, boron, or silicon, or threads of an aromatic polyamide, such as the polymer of p-phenylene terephthalamide or similar ones like polyamide-imides, polyimides, etc. These substances have poor resistance to abrasion, outside as well as inside.

The wrapping thread around the core is a synthetic textile material of continuous threads, for example, polyester, polyamide 6—6, or polyamide 6.

If required, the core may be composed of an aggregation of several multithreaded and parallel subcores with very little torsion, on the order of a hundred (100) turns per meter.

The joining together of the core and the wrapping thread is achieved either by several separate thread-like elements spaced apart on the peripheral surface of said core, or by a spiral of joined or unjoined turns, preferably in the opposite direction to the spiral formed by the wrapping thread.

As a material which permits the joining together by thermofusion of the core with the wrapping thread, a thread-like material is used, which consists of, for example, a multifilament thread made of a thermofusible substance compatible at the same time with the kind of threads forming the core as well as with the kind of threads forming the wrapping thread. This thread-like material has a fusion temperature lower than the fusion temperature, and in practice also the degredation temperature, of the core thread and the wrapping thread.

A thread-like element which is particularly convenient for the implementation of the invention is composed of a threaded formed of a copolyamide 6 commercially sold under the name of GRILLON by the Grillon Company. The amount of this thread will be chosen in a way that the quantity which it represents in the formed unit does not exceed ten percent (10%) in weight.

A procedure for the manufacture of thread in accordance with the invention consists of winding in a known and simple way in joined and regular turns, a thread of the multifilament wrapping, preferably a synthetic thermoplastic material, around a core thread which consists of threads arranged almost parallel to each other. Between the core and the wrapping thread, there is provided at least one thread-like element made from a thermofusible substance with a fusion temperature which is less than the fusion temperature of the core and of the wrapping.

Then the unit made this way is thermally treated in order to achieve the fusion of the thread-like element and the joining together, by thermofusion, of the core with the wrapping thread. This thermal treatment can be achieved either continuously before winding on, or by a subsequent process.

According to one way of implementing the invention, one puts in at least one and preferably three thread-like elements, with the thread like elements being spaced apart at the periphery of the core. These threads are lined up parallel to the mentioned core before the winding, and are put between the wrapping thread and the core. In this way, after the thermal treatment, considerable joining together of the core and the wrapping thread is obtained by use of the thread-like elements. Such a technique is particularly economic and simple because it requires one single operation.

In an alternative procedure, prior to the winding of the wrapping thread, one makes a first winding, looose or with joined turns, by means of a thread-like thermofusible element. Preferably, this winding is carried out in the opposite direction of the final winding by the wrapping thread. After the thermal treatment, in this case, one obtains a joining by fusion of the core with the wrapping thread appreciably in the form of a spiral with joined or unjoined threads.

Finally, if the core is composed of a plurality of basic multithreaded subcores, it is possible to proceed either as previously shown, or by wrapping each of the basic subcores, for example by winding with a thermofusible thread. After the thermal treatment, a binding by heat sealing is obtained by binding the subcores among themselves, on the one hand, and by binding those subcores with the wrapping thread, on the other.

The way in which the invention can be carried out and the advantages which derive from it are better shown by the preferred embodiments, given as a guide but not restrictive, and which are illustrated by the appended drawings.

BRIEF DESCRIPTION OF THE DRAWINGS

FIGS. 1, 2, and 3 represent summarily, in perspective, threads made according to the invention before the heat treatment permitting the heat sealing of the core with the outer wrapping thread.

DESCRIPTION OF THE PREFERRED EMBODIMENTS

Figure 4:
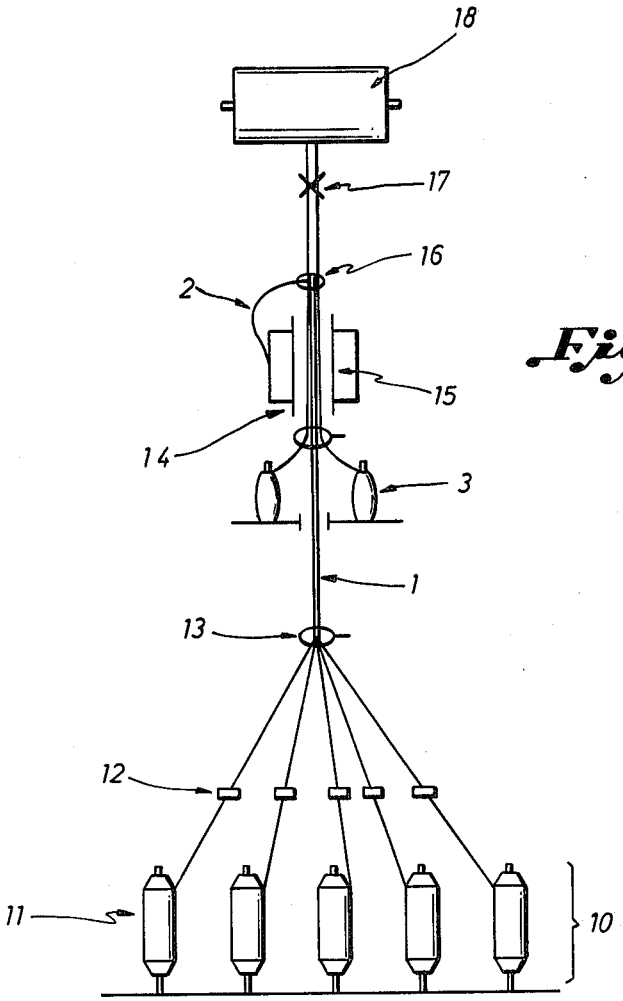
FIG. 4 illustrates schematically, an installation which permits the production of a thread such as the one shown in FIG. 1.

In a general way, according to the invention, the textile threads consist of a plurality of threads which are arranged substantially parallel to each other to form a core, and this core is covered by a wrapping thread, wound in a single turn to form a regular and joined spiral. In accordance with the invention, at least one part of the peripheral surface of the core is joined together by heat fusion with the wrapping thread.

In the example shown in FIG. 1, the wrapping thread 2 is joined together with core 1 by heat fusion by means of several thread-like elements 3 spaced apart on this core 1.

Such a thread can be produced by an installation such as that shown schematically in FIG. 4. In this manner of manufacture, core 1 is composed of five basic threads 11, joined with themselves without notable torsion, which means practically parallel. These threads come from a core 10, whereupon the bobbins of basic thread 11, are placed; then they pass through tighteners 12, for example, of a bar or rack type, and they are joined together by a convergence guide 13 in such a way as to form an aggregation, without appreciable torsion, of a plurality of threads composing core 1.

From spindle 14, kept continuously rotating, for example by a strap not shown, carrying a bobbin 15 of wrapping thread 2, said wrapping thread 2 is wound up in regular and joined turns around the formed core 1. This operation of winding is carried out in a conventional manner and will not be described in detail. The assemblage is made at the level of a guide 16, and then the wrapped thread is wound on a receiving bobbin in a classical manner by means of a guide 17 which goes back and forth on a receiving bobbin 18.

In accordance with the invention, one brings forward in parallel fashion, the thread-like elements 3 carried by the bobbins under the hollow spindle 14 before wrapping of the core thread 1 by the wrapping thread 2, and the thread-like elements 3 are spooled to the periphery of the formed core 1. These thread-like elements consist of a thread with a fusion temperature less than the fusion temperature of the wrapping thread 2 and the threads of core 1. These threads 3 are, therefore, surrounded and held by the wrapping thread 2. Before the winding on, or at a later stage, according to the invention, the formed thread is submitted to a heat treatment at a temperature which provokes the fusion of the thread-like elements 3 followed by the heat sealing of the core with the wrapping thread 2.

In the example shown in FIG. 2, the thermofusible thread-like element 6 is not arranged as separate thread-like elements spaced apart on the core but rather covers the core, for example, by the wrapping around of the core in joined or unjoined turns. This operation is carried out with the same material as that previously described. After this has been done, the final wrapping is carried out with the wrapping thread 5 in an equally conventional material. In this case, the two windings are carried out preferably in the opposite direction. After the thread has been made, it is likewise heat treated in a way to provoke the fusion of the thread-like element 6, thereby bringing about the binding of core 4 with the wrapping thread 5.

In the method of carrying out the invention which is shown by FIG. 3, core 7 is equally composed of the aggregation without appreciable torsion of five (5) basic subcores. Prior to their aggregation and to their wrapping by thread 8, these ends were wrapped individually by a thread-like element 9. The unit thus formed is likewise submitted to a heat treatment which provokes the fusion of the thread-like elements 9 and the heat sealing, on the one hand, of the basic subcores among themselves, and the sealing of these subcores with the wrapping thread 8, on the other.

EXAMPLE 1

With textile material for conventional wrapping such as that shown in FIG. 4, a thread is produced which is in accord with the invention, and which is pictured in FIG. 1.

This thread is composed of a core 1 of six (6) basic threads made of poly (p-phenylene terephthalamide), commercially sold by the E.I. DuPont de Nemours & Company under the trademark KEVLAR, with the individual fineness of 1,670 decitex, each basic thread composed of 1000 strands, not allowing any torsion, and a wrapping thread 2 composed of a polyester thread, 440 decitex, 100 strands, zero (0) torsion turn per meter. Prior to the wrapping, three (3) threads are formed, the three threads being composed of a copolyamide 6—6 of 220 decitex, 20 strands, commercially sold under the name GRILLON by the Grillon Company.

The winding of the wrapping thread 2 is done in such a way that the spiral turns formed around the core are regular and joined ones. This wrapping is made by 2000 turns per meter in an S direction.

The formed thread in which the GRILLON threads are firmly held between the core and the wrapping thread, is wound, and the formed bobbins are heat treated with steam at a temperature of one hundred five degrees Centigrade (105° C.) for thirty (30) minutes. This operation of heat treatment achieves the fusion of the three threads made of GRILLON and provokes the binding of core 1 with the thread of outside wrapping 2. This outside wrapping 2 is kept completely against core 1 and protects the threads which compose it against outside abrasion, and to a certain degree, equally against interior abrasion of the threads among themselves.

EXAMPLE 2

Example 1 is repeated with the variation that instead of incorporating three parallel GRILLON threads with the formed core thread 4 the core is covered beforehand by wrapping (as shown in FIG. 2) with a GRILLON thread 6 of 220 decitex, 20 strands, wound with 300 turns per meter around the core. This is done in the opposite direction of the external wrapping, i.e., in the Z direction in the present case.

After this thread has been made, an external wrapping 5 is produced in the same way as in Example 1, and with the same polyester thread.

As done before, the obtained thread is heat treated with steam at one hundred five degrees Centigrade (105° C.) for thirty (30) minutes, and the fusion of the GRILLON thread 6 would around core 4 is equally provoked. In this case, the binding of core 4 with the outside wrapping 5 is appreciably done in a spiral with practically joined turns.

The obtained thread also shows a very good resistance against outside abrasion, as well as an excellent protection against internal abrasion.

EXAMPLE 3

A thread a shown in FIG. 3 is produced.

This thread is composed of a core 7 formed by six (6) basicc subcores of a poly-(p-phenylene terephthalamide) commercially sold by the E.I. DuPont de Nemours & Company under the brand name KEVLAR with an individual fineness of 1,670 decitex, 1000 strands, without torsion.

Prior to the winding with the wrapping thread 8, each of these basic subcores is covered by a GRILLON 9 thread with the fineness 220 decitex, 20 strands, the winding being carried out by 2,150 turns per meter in the Z direction.

As in Example 1, five (5) of these basic wrapped threads are joined by using a wrapping thread 8, wound with joined turns, made of polyester of 400 decitex, 100 strands, the wrapping being carried out with 2,100 turns per meter in the S direction.

The threads thus produced are submitted to a heat treatment with steam of a duration of thirty (30) minutes at a temperature of one hundred and five degrees Centigrade (105° C.). This treatment achieves the melting of the GRILLON wrapping 9 and provokes the binding, on the one hand, of the basic subcores 7, among themselves, and on the other hand, the binding with the wrapping thread 8.

Such a thread provides, in comparison to the previously produced threads, a more improved protection of the outside surface, as well as improved protection against internal abrasion.

The threads which are obtained in accordance with the invention are essentially characterized by a substantial, if not total, decrease of the sliding of the wrapping thread about the core thread, and this is the case, if ever the latter has a considerably larger diameter than said wrapping thread. Furthermore, these threads retain all the properties of the core, given the small proportion of the wrapping thread and the material which permits the heat fusion. These threads can be successfully used in all applications called upon where the core thread is a fragile material. As examples, industrial fabrics, cables, straps, screens, etc., can be mentioned.

In another respect, given the fact that the material permits the binding of the core with the wrapping thread, the carrying ouf of the process of the present invention is particularly easy to achieve because of the presence of a thread-like binding element. Special material, such as a device for the binding material, is not necessary since this thread-like element can be directly built into the material which serves to produce the thread itself.

What is claimed is:

1. A wrapped textile thread comprising threads arranged considerably parallel to each other to form a core, wherein the multithreaded core is composed of a plurality of individual threads made from a fragile textile substance selected from the group consisting of glass fibers, fibers of refractory material, wherein the refractory material is carbon, boron or silicon, and fibers of an aromatic polyamide, said core being covered by a wrapping thread with a simple regular and spiral winding, wherein at least part of the peripheral surface of the core has been joined together by heat fusion with the wrapping thread, wherein the joining together of the core with the wrapping thread is obtained by a thread-like thermofusible material which is at once compatible with the nature of the wrapping thread and which has a fusion temperature which is lower than the fusion temperature of the core thread and the wrapping thread.

2. A wrapped textile thread according to claim 1 wherein the wrapping thread is a synthetic textile material with continuous threads selected from the group consisting of polyester, polyamide 6—6, and polyamide 6.

3. A wrapped textile thread according to claim 1 or 2 wherein it has, as a weight percent of the whole formed thread assemblage, at the most ten percent (10%) heat fusible substance that permits the binding of the core with the wrapping thread and at the most twenty-five percent (25%) wrapping thread.

4. A wrapped textile thread according to claim 1 or 2 wherein the joining together by heat fusion of the core with the wrapping thread is achieved by two or more separate thread-like elements spaced apart on the peripheral surface of said core.

5. A wrapped textile thread according to claim 1 or 2 wherein the joining together by heat fusion of the core with the wrapping thread is carried out in the form of a spiral with joined or unjoined turns.

6. A wrapped textile thread according to claim 5 wherein the spiral of thread-like and thermofusible material is in the opposite direction to the spiral which is formed by the wrapping thread.

* * * * *